US006079341A

United States Patent [19]

Resta

[11] Patent Number: 6,079,341

[45] Date of Patent: Jun. 27, 2000

[54] QUILTING MACHINE WITH STITCHERS MOVED BY LINEAR ELECTRIC MOTORS

[75] Inventor: Roberto Resta, Faenza, Italy

[73] Assignee: Resta S.r.l., Faenza, Italy

[21] Appl. No.: 09/231,296

[22] Filed: Jan. 15, 1999

[30] Foreign Application Priority Data

Jan. 23, 1998 [IT] Italy ..... BO98A0021

[51] Int. Cl.[7] ..... D05B 11/00

[52] U.S. Cl. ..... 112/117

[58] Field of Search ..... 112/117, 118, 112/470.12, 289, 221, 98; 310/12, 13, 27, 112, 264, 254, 255; 318/9, 569, 115, 135

[56] References Cited

U.S. PATENT DOCUMENTS 5,103,747 4/1992 Resta et al. ..... 112/117
5,130,583 7/1992 Andoh ..... 310/12
5,287,820 2/1994 Stutznacker ..... 112/117
5,736,693 4/1998 Piech et al. ..... 310/12 X
5,782,193 7/1998 Schwarzberger et al. ..... 112/117 X
5,832,849 11/1998 Kaetterhenry et al. ..... 112/117

*Primary Examiner*—Ismael Izaguirre
*Attorney, Agent, or Firm*—Guido Modiano; Albert Josif

[57] ABSTRACT

A quilting machine which comprises a frame composed of a first beam, arranged horizontally above the cloth to be quilted, and of a second beam arranged below the cloth, the beams being provided with respective guides for the carriages that support the sewing head and respectively the hook assembly of at least one stitcher, characterized in that in order to move the sewing head and the hook assembly of the stitcher there are respective linear motors, in which the inductor elements are arranged on the upper beam and lower beam, respectively, and the armature windings are arranged on the carriages that support the sewing head and the hook respectively.

2 Claims, 3 Drawing Sheets

QUILTING MACHINE WITH STITCHERS MOVED BY LINEAR ELECTRIC MOTORS

BACKGROUND OF THE INVENTION

The present invention relates to a quilting machine with stitchers moved by linear electric motors.

It is known that a quilting machine comprises a cloth supporting carriage and one or more stitchers for quilting the cloth according to a preset pattern.

In most currently commercially available quilting machines the cloth supporting carriage moves along a linear path, while the stitchers are mounted so that they are slideable on a frame and are guided at right angles to the path of the carriage. The combination of the movements of the carriage and of the stitchers allows the sewing needle to move with two degrees of freedom in order to form a seam which follows the intended path.

In such quilting machines, the frame comprises a first beam, which lies above the cloth, and a second beam, which is parallel to said first beam and lies below the cloth.

The first beam supports a guide for the sewing head of the stitcher, while the second beam supports a guide for the so-called "crochet" device.

In order to allow the sewing needle to operate concordantly with the hook assembly, mechanical transmissions and/or electrical connections are provided so that the sewing needle moves synchronously and in perfect vertical alignment with the hook assembly during its movements over the cloth.

Said conventional devices have rather long response times and operating limitations when it is necessary to manage a plurality of stitchers which operate simultaneously on the same cloth.

SUMMARY OF THE INVENTION

The aim of the present invention is to provide a quilting machine which does not suffer the drawbacks of conventional ones, i.e., which is capable of ensuring the alignment of the sewing head with the hook assembly precisely by using means which have a simple structure and high reliability.

Within the scope of this aim, an object of the present invention is to provide a quilting machine comprising a plurality of stitchers which is actuatable so as to work independently of each other to form variously arranged seams.

This aim is achieved with a quilting machine which comprises a frame composed of a first beam, arranged horizontally above the cloth to be quilted, and of a second beam arranged below said cloth, said beams being provided with respective guides for the carriages that support the sewing head and respectively the hook assembly of at least one stitcher, characterized in that in order to move said sewing head and said hook assembly of said stitcher there are respective linear motors, in which the inductor elements are arranged on said upper beam and lower beam, respectively, and the armature windings are arranged on said carriages that support the sewing head and said hook assembly respectively.

BRIEF DESCRIPTION OF THE DRAWINGS

Further characteristics and advantages of the present invention will become apparent from the following detailed description of a preferred embodiment, illustrated by way of non-limitative example in the accompanying drawings, wherein.

DESCRIPTION OF THE PREFERRED EMBODIMENTS

Figure 1:
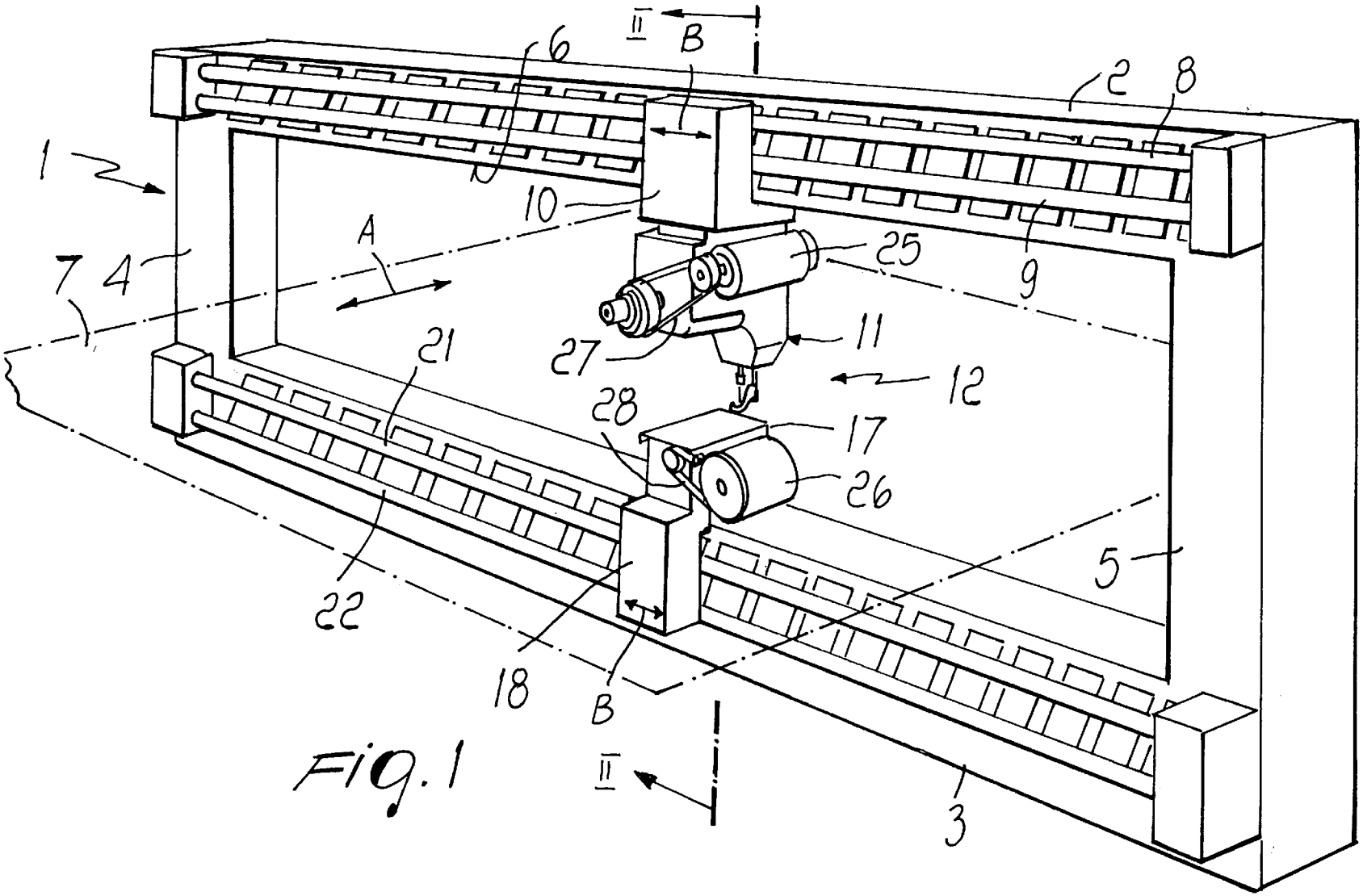
FIG. 1 is a perspective view of a frame for supporting the stitchers in a quilting machine.

With reference to the above Figures, 1 designates the frame of a quilting machine which is composed of two horizontal beams 2 and 3 which are connected, at their opposite ends, by two respective vertical posts 4 and 5.

The beams 2, 3 and the posts 4, 5 enclose an opening 6, through which the cloth 7 to be quilted is guided. For the sake of clarity, it is assumed that the cloth 7 is stretched horizontally on a supporting frame (not shown) which is movable in the direction A at right angles to the frame 1.

Two mutually parallel cylindrical bars 8, 9 are fixed to the ends of the beam 2 and are spaced from said beam. The bars 8 and 9 form a guide along which a carriage 10 is slideable; said carriage is meant to support the sewing head 11 of a stitcher which is generally designated by the reference numeral 12. Sliding is ensured by a pair of freely rotating wheels 13 and 14 which have hollow rims and are tangentially engaged above the bar 8 and below the bar 9.

The inductor magnets 15 of a linear motor are fixed to the face of the beam 2 that is adjacent to the bars 8, 9; their armature winding 16 is fixed to the carriage 10 and protrudes between the bars 8 and 9. The activation of the linear motor 15, 16 causes the movement of the carriage 10 and therefore of the sewing head 11 along the guide 8, 9 in the direction B, at right angles to the direction A in which the cloth moves.

The stitcher 12 comprises a hook assembly 17 which is actuated synchronously with the sewing head 11. The device 17 is mounted on a carriage 18 which, by means of pairs of wheels with hollow rims 19 and 20, is slideable in the direction B along a pair of bars 21 and 22 which are fixed by their ends to the lower beam 3 and are parallel to the bars 8 and 9.

The lower carriage 18 is moved by a linear motor of its own, which is composed of inductor magnets 23 and of an armature winding 24. The inductor magnets 23 are fixed to the front face of the beam 3, which is directed toward the bars 21 and 22, while the armature winding 24 protrudes between said bars in order to cooperate with the inductor magnets 23.

The operation of the quilting machine is illustrated hereinafter with reference to FIG. 3, which is a view of an embodiment which comprises two stitchers, which are of the type designated by the reference numeral 12 in the example of FIGS. 1 and 2 and are designated by the reference numerals 12*a* and 12*b*. The sewing heads and hook assemblies that compose the stitchers 12*a*, 12*b* and the corresponding supporting carriages are designated by the same reference numerals used earlier in the example of FIGS. 1 and 2, with the addition of the letters a and b respectively.

The carriages 10*a*, 10*b* and 18*a*, 18*b* are actuated by a linear motor of their own, which is composed of an inductor 16*a*, 16*b* and 24*a*, 24*b* and of inductor magnets which, since they are common to both motors, are designated by the reference numerals 15 and 23, as in the previously described example.

Figure 2:
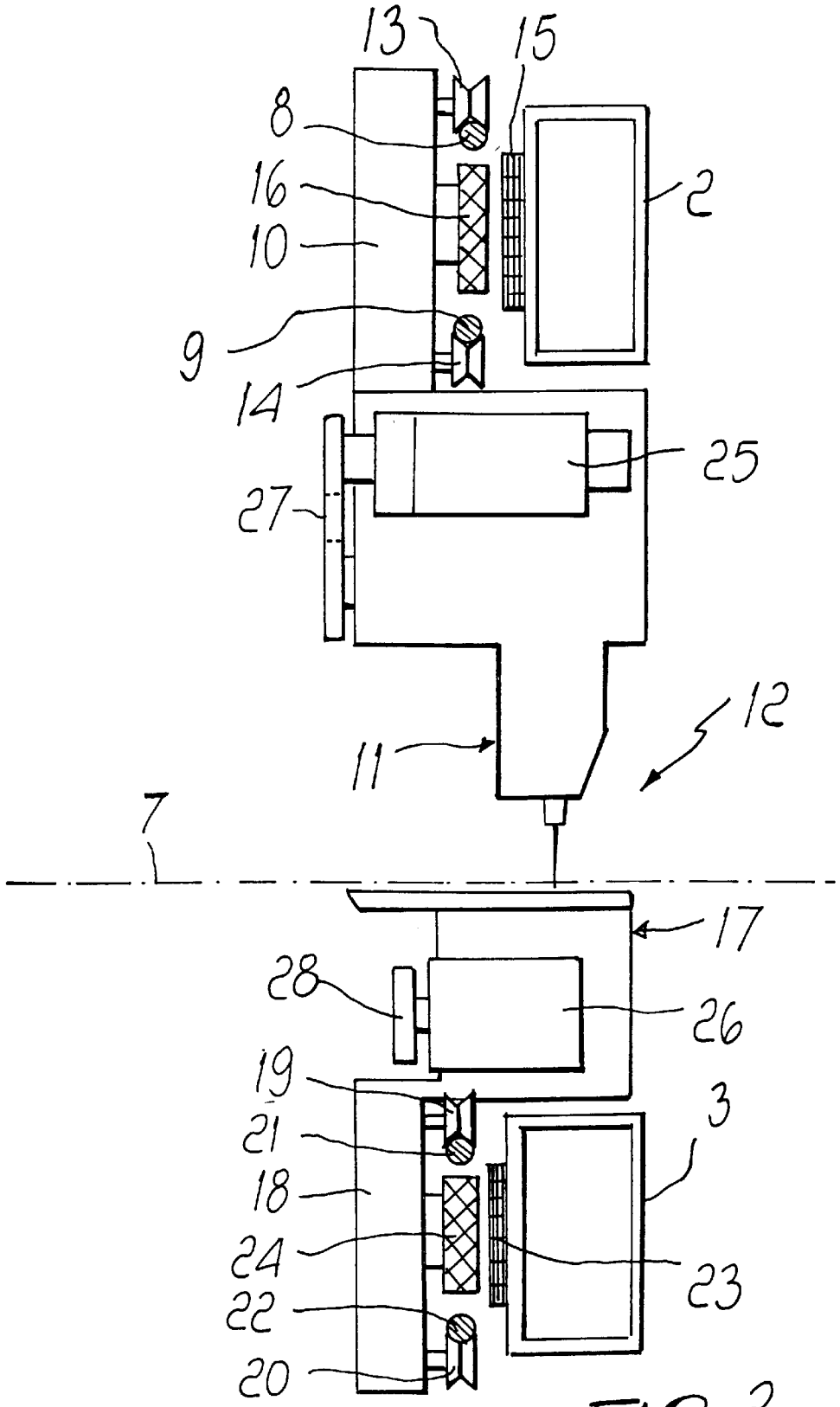
FIG. 2 is a sectional view, taken along the plane II—II of FIG. 1.
Figure 3:
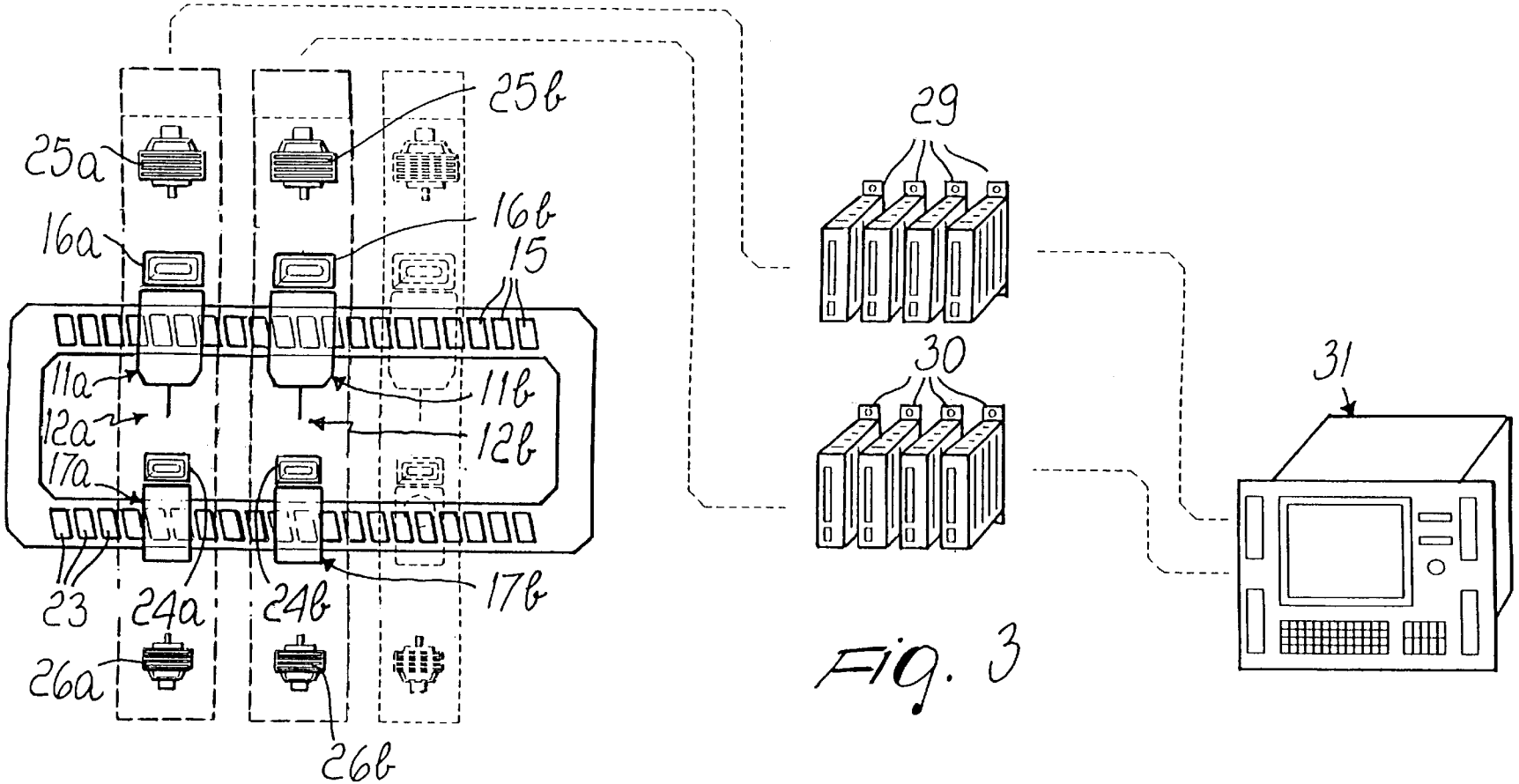
FIG. 3 is a front view of the frame, schematically showing the arrangement of the inductor and of the armature of the linear motors.

In FIG. 3, the numerals 25*a* and 25*b* schematically designate the two electric motors that operate the needles of the sewing heads 11*a*, 11*b*, and the numerals 26*a* and 26*b* schematically designate the two electric motors that operate the hook assemblies 17*a*, 17*b* and which, in FIG. 1 of the previously described example, have been designated by the reference numerals 25 and 26; said motors move the needle of the sewing head 11 and the hook assembly 17 by means of belt drives 27 and 28.

The armature windings of the linear motors 16*a*, 15 and 16*b*, 15 that operate the sewing heads 11*a*, 11*b*, the armature windings of the linear motors 24*a*, 23 and 24*b*, 23 that operate the hook assemblies 17*a*, 17*b*, and the motors 25*a*, 25*b*, 26*a*, 26*b* are powered by way of respective power stages 29 and 30 controlled by a CNC (computerized numeric control) unit 31.

The unit 31 is capable of driving the stitchers 12*a*, 12*b* independently of each other, so as to ensure maximum operating versatility as regards the paths of the seams formed by said stitchers. In particular, the linear motors ensure perfect synchronization and perfect vertical alignment of the needles and of the crochet.

It is further possible to adjust the speed of the motors 25*a*, 25*b*, 26*a*, 26*b* so as to maintain a constant stitch length regardless of the direction B in which the stitchers 12*a*, 12*b* move with respect to the direction A in which the cloth 7 moves.

Numerous modifications and variations are possible in the practical embodiment of the invention, and all are within the scope of the same inventive concept. For example, instead of moving the cloth 7 with respect to the frame 1, it is possible to keep the cloth motionless and move the frame 1 on rails in the direction A.

The disclosures in Italian Patent Application No. BO98A000021 from which this application claims priority are incorporated herein by reference.

What is claimed is:

1. A quilting machine for quilting cloth, comprising: a frame composed of a first upper beam, arranged horizontally above a cloth to be quilted, and of a second lower beam arranged below said cloth; at least one stitcher having a sewing head and a hook assembly; carriages for supporting respectively said sewing head and said hook assembly; said carriages being movable along said beams; guide means provided at said beams for guiding said carriages during movement thereof; and driving linear motors having inductor elements, which are arranged at said upper beam and lower beam respectively, and armature windings which are arranged at said carriages that support said sewing head and said hook assembly respectively, said linear motors driving said carriages for movement along said beams.

2. The quilting machine of claim 1, comprising: electrical motors for driving the sewing heads and the hook assemblies; power stages; and a computerized numeric control unit CNC, said armature windings of the linear motors and said electrical motors that drive the sewing head and the hook assembly being powered by way of said power stages which are controlled by said computerized numeric control unit.

* * * * *